US008866597B2

(12) United States Patent
Brendel

(10) Patent No.: US 8,866,597 B2
(45) Date of Patent: Oct. 21, 2014

(54) RADIO REMOTE CONTROL WITH POSITION SENSOR SYSTEM

(76) Inventor: Wolfgang Brendel, Crailsheim (DE)

( * ) Notice: Subject to any disclaimer, the term of this patent is extended or adjusted under 35 U.S.C. 154(b) by 122 days.

(21) Appl. No.: 13/818,148

(22) PCT Filed: Aug. 31, 2010

(86) PCT No.: PCT/EP2010/062706

§ 371 (c)(1),
(2), (4) Date: Feb. 21, 2013

(87) PCT Pub. No.: WO2012/028175
PCT Pub. Date: Mar. 8, 2012

(65) Prior Publication Data

US 2013/0147611 A1 Jun. 13, 2013

(51) Int. Cl.
*G08C 19/16* (2006.01)
*G08C 17/02* (2006.01)

(52) U.S. Cl.
CPC ..... *G08C 17/02* (2013.01); *G08C 2201/50* (2013.01); *G08C 2201/32* (2013.01)
USPC ..... 340/12.5

(58) Field of Classification Search
USPC ..... 340/12.5, 502, 539.23, 686.6, 4.11, 340/13.24, 313; 345/156; 715/700
See application file for complete search history.

(56) References Cited

U.S. PATENT DOCUMENTS

| | | | | |
|---|---|---|---|---|
| 5,444,462 | A * | 8/1995 | Wambach | 345/158 |
| 6,346,891 | B1 * | 2/2002 | Feinleib et al. | 340/12.3 |
| 7,173,604 | B2 * | 2/2007 | Marvit et al. | 345/156 |
| 8,503,932 | B2 * | 8/2013 | Demuynck et al. | 455/41.2 |
| 2005/0212911 | A1 | 9/2005 | Marvit et al. | |
| 2008/0150749 | A1 | 6/2008 | Lin | |
| 2010/0283625 | A1 * | 11/2010 | Inagawa et al. | 340/825.36 |

FOREIGN PATENT DOCUMENTS

| | | | |
|---|---|---|---|
| DE | 10 2004 009561 | A1 | 11/2004 |
| JP | 2009-137750 | A | 6/2009 |
| JP | 2009-137750 | B2 | 6/2009 |
| JP | 2009-208918 | A | 9/2009 |
| JP | 2009-208918 | B2 | 9/2009 |
| JP | 2009-208919 | B2 | 9/2009 |

* cited by examiner

*Primary Examiner* — Phung Nguyen
(74) *Attorney, Agent, or Firm* — Rothwell, Figg, Ernst & Manbeck, P.C.

(57) ABSTRACT

The present invention relates to a radio remote control system of a machine that comprises at least one machine drive for a moveable machine part, which machine drive can be controlled by the radio remote control system, comprising a hand-held unit (10) comprising a control unit, a transmitter and at least one motion sensor, wherein the control unit is configured to communicate control commands issued by a user to a transmitter, and to cause the transmitter to transmit the control commands to the machine, in particular to an associated receiver, and wherein movements of the hand-held unit (10) in space about at least one tilt axis or pitch axis (KA, DA) can be detected by the motion sensor in such a way that in a motion control mode, the detected movements can be converted by the control unit into control commands, which can be communicated to the machine, wherein the motion control mode can be activated by a user input at the hand-held unit (10). It is proposed according to the invention that the control unit is also configured such that on activating the motion control mode, the current attitude (I) of the hand-held unit (10) in space is detected as the current reference attitude (I), so that movements relative to this current reference attitude (I) can be detected by the motion sensor, and can be communicated by the control unit as control commands to the machine. The invention also relates to an operating method for a radio remote control system according to the invention.

13 Claims, 4 Drawing Sheets

RADIO REMOTE CONTROL WITH POSITION SENSOR SYSTEM

CROSS REFERENCE TO RELATED APPLICATION

This application is a 35 U.S.C. 371 National Phase Entry Application from PCT/EP2010/062706, filed Aug. 31, 2010, the disclosure of which is incorporated herein in its entirety by reference.

The present invention relates to a radio remote control system of a machine that comprises at least one machine drive for a moveable machine part, which machine drive can be controlled by the radio remote control system, comprising a radio receiver assigned to the machine, and a hand-held unit comprising a control unit, a transmitter and at least one motion sensor, wherein the control unit is configured to communicate control commands issued by a user to the transmitter, and to cause the transmitter to transmit the control commands to the receiver, and wherein movements of the hand-held unit in space about at least one tilt axis or pitch axis (KA, DA) can be detected by the motion sensor in such a way that in a motion control mode, the detected movements can be converted by the control unit into control commands, which can be communicated to the machine by radio transmission between transmitter and receiver, wherein the motion control mode can be activated by a user input at the hand-held unit.

A particularly preferred although not exclusive application of the present invention is the control of cranes and lifting gear. In the example of a jib crane, for instance a construction crane, it is possible to control e.g. the orientation of the jib (angle of rotation), the movement of the trolley and the movement of the hook using a suitably designed radio remote control system according to the invention.

It is known to control equipment by means of attitude sensors in a remote controller or a component similar to a remote controller. Reference is made by way of example to games consoles or the like. Nowadays, attitude sensors are also fitted, for instance, in mobile phones so that it is possible to determine the orientation of such a device, in particular the orientation of the device display, in order to adjust what is shown in the display to the orientation of the device.

In order to be able to make optimum use of a radio remote control system for a machine, it is necessary to be able to detect movements of the hand-held unit in space precisely. It must also be ensured that the radio remote control system enables machine control that is intuitive to a user by means of the hand-held unit, in particular if the user is to operate the machine by moving the hand-held unit.

It is the object of the invention to improve a radio remote control system of the type in question with regard to intuitive operation by a user.

For this purpose, it is proposed according to a first aspect that the control unit is configured such that on activating the motion control mode, the current attitude of the hand-held unit in space is detected as the current reference attitude, so that movements relative to this current reference attitude can be detected by the motion sensor, and can be communicated by the control unit as control commands to the machine.

In such an embodiment of the control unit, it is possible to determine the current reference attitude in a hand position that is comfortable for a user. A hand-held unit of a radio remote control system is often not held exactly horizontally, but a natural pose of the human hand results in the hand-held unit being held with a slight upwards inclination. This natural pose can then be determined as the current reference attitude, in other words as a type of neutral position, so that movements detected by the motion sensor, for instance movements such as rotation, pitching or tilting of the hand-held unit, can be detected and converted into control commands. Starting from such a natural position of the human hand also results in optimum utilisation of the possible movements by the user for the purpose of controlling a suitable machine drive.

According to a second aspect of the invention, it is proposed that the radio remote control system is configured such that on activating the motion control mode, the current attitude of the hand-held unit in space is detected, and is compared with a predetermined reference attitude, and such that detected movements cannot be communicated to the machine as control commands until the radio remote control system has been brought at least approximately into the predetermined reference attitude, wherein movements relative to the predetermined reference attitude are detected for the purpose of generating control commands.

The predetermined reference attitude may be, for example, a substantially horizontal orientation of the hand-held unit in space. This predetermined reference attitude must be reached or adopted from an attitude of the hand-held unit in space in which the motion control system is activated. As soon as the hand-held unit has been brought into, or on activating the motion control system is already in, a current attitude that corresponds approximately to the predetermined reference attitude, i.e. this predetermined reference attitude lies within a tolerance range, then further movements of the hand-held unit out of the predetermined reference attitude are detected and converted into control commands, which can be communicated to the machine.

Both of the above-mentioned aspects of the invention enable intuitive operation and control of a machine by means of a hand-held unit which contains motion sensors, and the control unit of which enables communication of detected movements as a control command to the machine.

Reference should be made in this regard to two different control-system operating options, which can be implemented in relevant embodiments of a radio remote control system according to the present invention. In a first control-system operating mode, the motion control mode is activated by operating a switch. This preferably enables a safety-related relay or the like that may be present in the machine, and then the hand-held unit is referenced according to one of the aforementioned referencing options. The movement to be controlled of the machine part is then defined by moving the hand-held unit relative to the detected reference attitude, wherein opposite directions of movement of the hand-held unit relative to the reference attitude can generate control commands that also cause the machine part to move in correspondingly opposite directions. The magnitude of the movement to be controlled, thus for instance the velocity magnitude or acceleration magnitude, can then also be defined by the amplitude of the movement of the hand-held unit relative to the reference attitude. An example of this is given, for instance, in that both the direction and the magnitude of the movement to be controlled of the machine part is defined by rolling the hand-held unit through e.g. +/−30° relative to a reference attitude detected when the motion control mode was enabled, where the positive range represents one direction of movement, and the negative range represents the opposite direction of movement of the machine part.

A second control-system operating mode provides that e.g. two contacts or pushbuttons are provided, which must be actuated to activate the motion control mode, where one of the buttons is assigned to one direction of movement of the machine part, whereas the other button is assigned to the opposite direction of movement of the machine part. Movement of the hand-held unit relative to the relevant reference attitude would then define e.g. only the magnitude of the velocity to be controlled of the machine part.

Momentary-action pushbutton switches, for instance, can be provided on the hand-held unit for the purpose of user input. Thus according to an embodiment of the invention, the motion control mode must be initiated by actuating a switch on the hand-held unit and maintained by continued touching of this switch in order to be able to control the movement of the machine part. Releasing this switch then results in no further control commands being transmitted for controlling the movement of the machine part. This is therefore a type of dead-man's switch.

According to a different embodiment of the invention, latching switches are provided on the hand-held unit for user input, by means of which the user can activate the motion control mode by an active switchover operation on one such latching switch.

It is proposed as a development that the radio remote control system comprises at least one output means assigned to the hand-held unit, said output means being configured such that it generates at the hand-held unit in response to detected movements at least one output perceptible to the user, in particular an optical and/or acoustic and/or haptic signal.

An output perceptible to the user of the hand-held unit improves the intuitive, remotely controlled operation of a machine. Acoustic and/or haptic signals in particular can assist the user in an intuitive manner with operating the machine by movements of the hand-held unit. The output performs a form of feedback to the user, so that the human-machine interface can be optimised.

It is proposed for this purpose in particular that the output means are configured such that the output perceptible to the user is generated on the basis of the signals output by the motion sensor.

The output means can be configured such that the output perceptible to the user is generated in a graduated manner on the basis of reaching certain signal strengths output by the motion sensor. It is thereby possible, for instance, to indicate the leaving of the reference attitude, and on reaching a certain relative attitude in space to give a further signal, which is used to indicate that a first movement level or control level has been reached. A further signal could be output, for example, when an extreme value of possible movement is reached.

Alternatively, the output means can be configured such that the output perceptible to the user is generated such that it is proportional to the signal strength output by the motion sensor. It is envisaged here in particular that starting from a reference attitude, an increasing pitching or tilting in one direction is represented by an increasing acoustic and/or haptic signal, so that the user can find out and assess from this output in what current attitude the user is holding the hand-held unit relative to the detected or predetermined reference attitude.

The output perceptible to the user can be generated according to a predefined characteristic on the basis of the signal strength output by the motion sensor. The characteristic curve can be optimised according to the type of control system, so that the dependency of the output perceptible to the user on the signal strength output by the motion sensor is directly proportional, i.e. linear, or degressive or progressive. In particular, a logarithmic characteristic is also possible.

According to a preferred embodiment of the invention, the output perceptible to the user from the at least one output means takes place differentially, i.e. only when the signal strength output by the motion sensor changes. A differential or dynamic output of this type normally provides the user with a sufficient subjective feedback sensation from the radio remote control system, and on average places a relatively low load on the power supply of the hand-held unit, because during the periods of constant signal output from the motion sensor, the output means does not need to be active. According to a variant of the invention, it is provided that in regard to generating the output perceptible to the user, it is possible to switch between above-mentioned operating modes, thus e.g. between a differential mode and a static-proportional mode.

The control unit is preferably configured such that movements detected by the or a motion sensor in a rotational or tilting working range of approximately −45° to +45° maximum, in particular −30° to +30°, about an associated horizontal rotation axis or tilt axis, are converted into control commands for the machine. This limiting of the range of movement that can be converted into control commands for the machine helps ergonomic handling of the hand-held unit, because it is uncomfortable for the human hand to make movements in a larger angular range. In addition, an angular range defined in this way can also serve to specify positions of the hand-held unit in which controlling movement by means of the hand-held unit is disabled, and no further control commands are sent to the machine as a result of detected movements. It is proposed in particular for this purpose that the output means are configured such that they indicate by a suitable output perceptible to the user that the maximum rotational or tilting movement is being approached and/or the rotational or tilting working range is being left.

As a development, the control unit can be configured such that on leaving the rotational or tilting working range, no further control commands are generated as a result of detected movements until further notice. According to a variant of the invention, however, safety-related control commands, e.g. stop commands, can be sent from the hand-held unit to the machine if the rotational or tilting working range is left. It is pointed out in this connection that leaving a preferred angular range or range of movement preferably only has an effect on controlling the machine by means of moving the hand-held unit, but not on controlling the machine by any other control elements on the hand-held unit such as pushbuttons, a joystick or the like. In addition, it is also pointed out that on leaving the rotational or tilting working range, it is defined in the machine controller whether the machine remains in its current state or is taken into a neutral position. In addition, it also needs to be specified whether the movements of all the machine parts that can be controlled by the radio remote control system are meant to be stopped in the event of leaving the rotational or tilting working range, or whether only those drives that are explicitly controlled by the motion control system are stopped. Relevant safety concepts and safety standards can be taken into account in specifying such operating strategies.

According to a preferred development of the invention, the receiver comprises a feedback transmitter and is configured to activate, on receiving control commands, the feedback transmitter to transmit feedback information, wherein the hand-held unit comprises a feedback receiver that is configured to receive the feedback information and is connected to the control unit. The receiver comprising feedback transmitter and the transmitter comprising feedback receiver and contained in the hand-held unit hence form a bidirectional radio remote control system having improved safety features. The hand-held unit preferably has an acoustic and/or optical and/or haptic indication device which is controlled by the control unit and which can be used to indicate operating function information from the radio remote control system according to the receipt of feedback signals from the feedback transmitter. Such an indication device therefore constitutes an output means that can inform the user about faults. The aspect of radio feedback, in particular in combination with the aforementioned indication device and the features of the preamble of claim 1, may be of inventive importance in its own right, and the applicant reserves the right to draft a corresponding independent claim.

A further advantageous aspect of the invention, which in combination with the features of the preamble of claim 1 may also be an independent aspect of the invention, is given by the features of claim 5, namely that a sensor device that acquires data about the actual position of the moveable machine part at that moment and/or about the state of motion of said part, and a transmitter transmitting the data from this sensor device as feedback information, are provided on the machine, and that the hand-held unit comprises a feedback receiver that is configured to receive the feedback information and is connected to the control device. The hand-held unit preferably has for this purpose an optical and/or acoustic and/or haptic indication device which is controlled by the control unit and represents the actual position at that moment and/or the current deviation of the actual position from the setpoint position defined by the instantaneous attitude of the hand-held unit and/or the velocity of movement of the moveable machine part. This indication device can therefore inform the user about the respective attitude, direction of movement and velocity of movement of the machine part. The indication device preferably comprises a display, e.g. an LCD display, on which the information can be displayed graphically as images or pictograms or videos and/or numerically as numerals and letters.

On the basis of the actual values acquired in this way, the predetermined reference attitude in the embodiment of the radio remote control system according to claim 2 can be determined such that it is always updated, e.g. during each switch-on procedure of the controller, according to the instantaneous attitude of the moveable machine part. In such an embodiment, the hand-held unit first retrieves the feedback information from the feedback transmitter on the machine, before it sends out new control commands.

In addition, it is provided according to a variant of the radio remote control system according to the invention that the control unit is configured to modify control commands for the machine as a function of the received feedback information. An example of this might be that as the moveable machine part approaches its setpoint position, the speed of the machine part is automatically reduced and/or the control characteristic is given a higher resolution in the sense of a more sensitive control system.

Within the scope of the invention, further feedback options can be provided in the radio remote control system according to the invention or in a machine equipped therewith, for instance the indication of certain machine responses or certain dynamic movement states of the machine or of the moveable machine part which are caused e.g. by control operations or switching operations from a control source other than the radio remote control system. Thus for instance, it may be necessary to control a machine in which the moveable machine part can be moved between two opposite limits of travel, and in which a limit-switch mechanism switches off the machine drive as soon as the movable machine part reaches the limit of travel or approaches within a short distance of same. According to a development of the present invention, the approach of the machine part to the limit of travel can also be communicated by radio to the hand-held unit via a feedback signal and routed there to a relevant optical and/or acoustic and/or haptic indicator so that the user is made aware of the relevant machine situation.

A further example of an override feedback of this type is e.g. a crane or lifting gear having what is known as load swing damping, in which the crane trolley or, if applicable, the crane jib, automatically makes compensating movements in order to counteract unwanted swinging of the load suspended from the crane. Such compensating movements can be indicated on the hand-held unit by means of radio feedback from the crane to the hand-held unit. In this case, particularly a haptic and/or acoustic indicator on the hand-held unit is advantageous in order to inform the user appropriately.

The invention also relates to an operating method for a radio remote control system of a machine having at least one machine drive for a moveable machine part, which machine drive can be controlled by the radio remote control system, comprising the steps:

transmission of control commands issued by a user on a hand-held unit of the radio remote control system from a transmitter of the hand-held unit to the machine, in particular to an associated receiver, and detection of movements of the hand-held unit in space about at least one tilt axis or pitch axis, the detected movements being converted in a motion control mode into control commands, which are communicated to the machine, wherein the motion control mode is activated by a user input at the hand-held unit, where it is proposed according to the invention that on activating the motion control mode, the current attitude of the hand-held unit in space is detected as the current reference attitude, so that movements can be detected relative to this current reference attitude, and can be communicated as control commands to the machine.

A further inventive aspect of the operating method can be seen in that on activating the motion control mode, the current attitude of the hand-held unit in space is detected and compared with a predetermined reference attitude, and wherein detected movements are not communicated to the machine as control commands until the hand-held unit has been brought at least approximately into the predetermined reference attitude, wherein movements relative to the predetermined reference attitude are detected for the purpose of generating control commands.

It is proposed as a development that in response to detected movements, at least one output perceptible to the user, in particular an optical and/or acoustic and/or haptic signal, is generated at the hand-held unit.

Other features proposed in relation to the radio remote control system described above can also be implemented in the operating method according to the invention. This relates in particular to the bidirectional operating methods employing the transmission and evaluation of feedback information.

DETAILED DESCRIPTION OF THE DRAWINGS

The invention is described below with reference to the attached drawings and referring by way of example and with no limiting effect to an embodiment.

Figure 1:
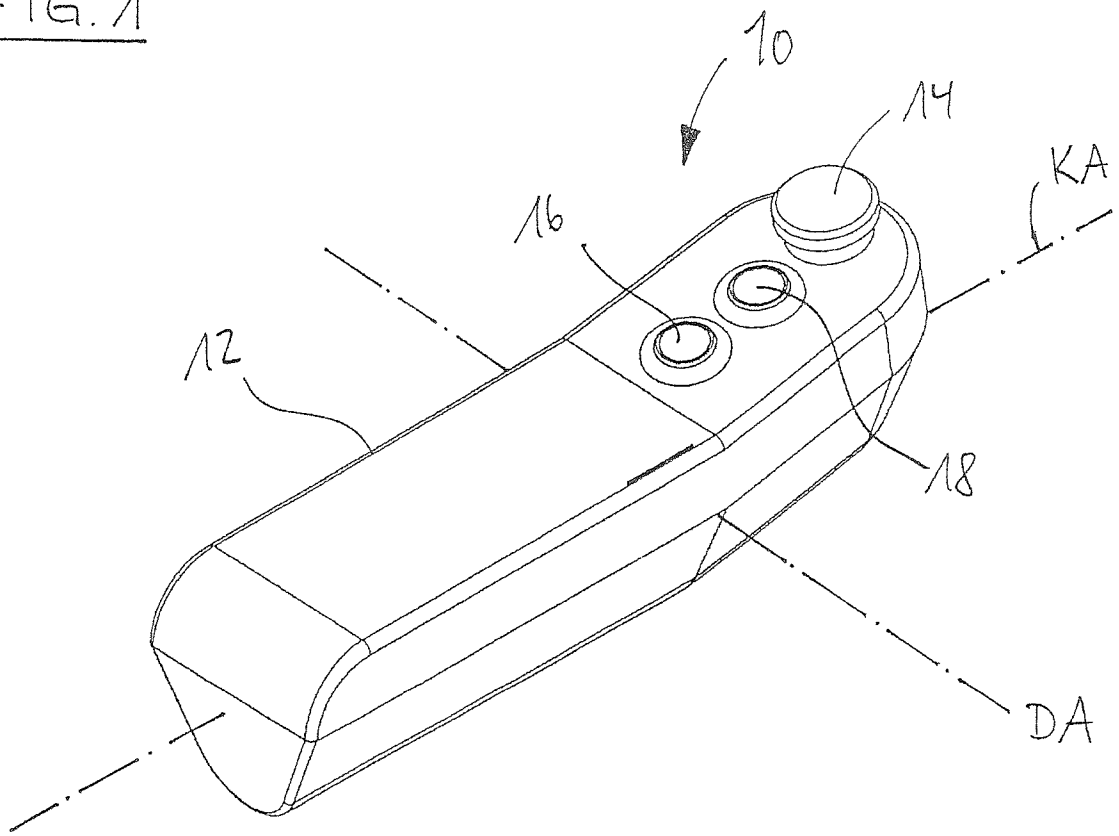
FIG. 1 shows a simplified, schematic perspective view of a hand-held unit of a radio remote control system.

FIG. 1 shows a simplified, schematic perspective view of a hand-held unit 10 of a radio remote control system for a machine. A machine is understood to mean equipment that has movable components, the respective attitude of which can be changed by suitable control. The remote control of cranes, arms of concrete pumps, hydraulically driven loading ramps on goods vehicles and the like are envisaged in particular.

The hand-held unit 10 comprises in its housing 12 at least one sensor, which is not shown in greater detail, by means of which movements of the hand-held unit 10 in space can be detected. It is envisaged in particular that the motion sensor(s) can detect rotational movements about a rotation axis or pitch axis DA and tilting movements about a tilt axis KA. The movements of the hand-held unit 10 can be detected by suitable angle sensors and attitude sensors. The attitude and/or motion sensors used preferably respond to gravity or the Earth's gravitational pull and therefore have an angle-dependent resolution or a maximum signal strength that depends on the rotational or tilting movement of the hand-held unit. Depending on the position chosen for fitting the attitude and/or motion sensors in the housing 12 of the hand-held unit, the output signal can be a maximum for a deflection about the horizontal and can approach zero when rotating or tilting into the vertical.

The hand-held unit shown here purely by way of example can comprise a form of joystick 14, which normally can be operated by a thumb of one hand of the user in order to control relevant machine parts remotely. In addition, two control buttons 16, 18 are shown, which can be actuated to activate further control options. One of these control buttons 16, 18 can be used, for example, to activate a motion control mode in which movements detected by the motion sensors (not shown) are actually converted into control commands in order to be able to control the machine according to movements made. In the form of a flip-flop switching mechanism, this control button can also be assigned to disabling this motion control mode when actuated again. Alternatively, enabling or disabling can be performed by different control buttons. In addition, an emergency stop switch, which is not shown in the present example however, can also be provided on a hand-held unit 10. The hand-held unit shown is purely an example and can be embodied differently both with regard to its external shape and with regard to further or different controls.

Figure 2:
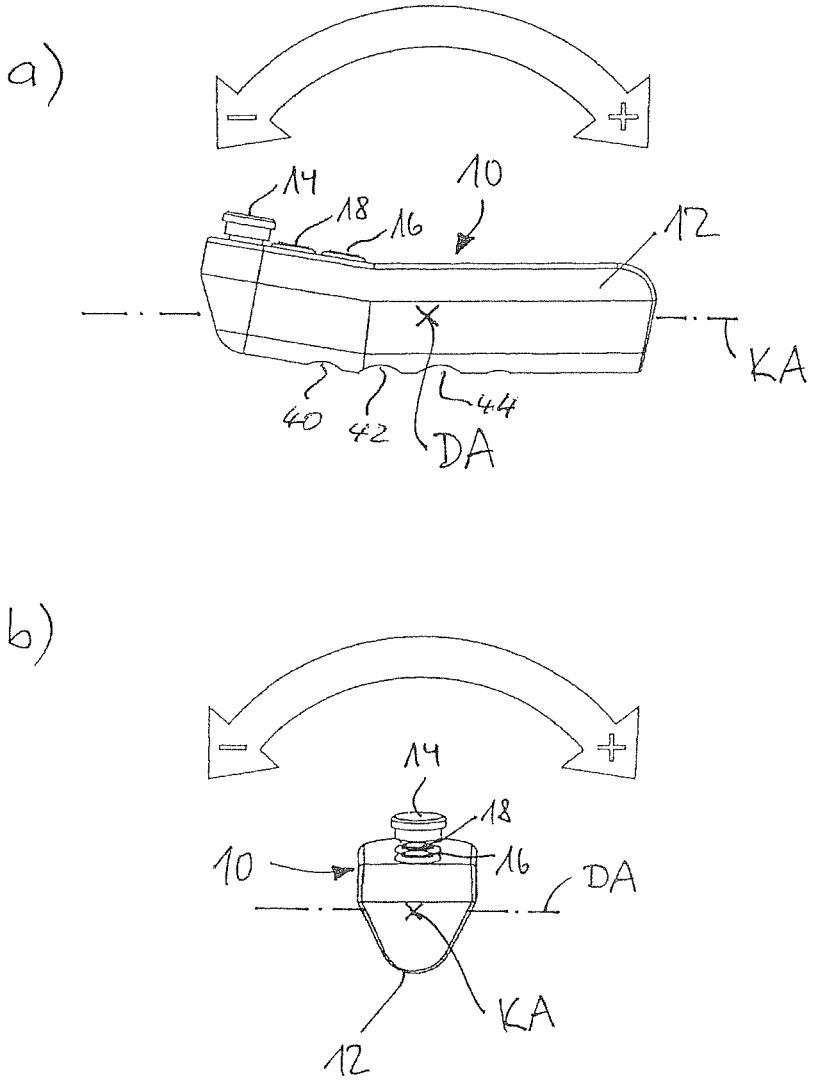
FIG. 2 shows in the sub-figures a) and b) different elevation views of the hand-held unit of FIG. 1.

As is shown in FIG. 2, the hand-held unit 10 can be rotated or pivoted about its rotation axis DA (pitch axis), which is indicated by the double-ended arrow. In addition, the hand-held unit 10 (FIG. 2 *b*)) can also be tilted or pivoted about its tilt axis KA, which is likewise indicated by the double-ended arrow. The movements about the rotation axis DA or tilt axis KA are detected by the motion sensor(s) and converted into control signals when a motion control mode is accordingly enabled, which signals are transmitted to the machine to be controlled remotely.

According to a variant of the invention, it can be provided that pivoting of the hand-held unit about the rotation axis DA and about the tilt axis KA is detected simultaneously and converted into corresponding control commands by the control unit. In this case, according to a development of this variant, it can be provided that optionally one of these control options can be disabled temporarily by a relevant input at the hand-held unit 10, so that e.g. as a result of pivoting the hand-held unit about the rotation axis DA, no corresponding control commands are communicated to the machine, and only pivoting about the tilt axis KA is detected and converted for the purpose of control. The same applies also to the inverse case in which pivoting about the tilt axis KA can be switched to be passive as a control instruction, so that then only rotations about the rotation axis DA produce relevant control commands for the machine. According to a further variant of the invention, these control operating modes can be selected also by active switching-on at the hand-held unit 10, for instance by actuating a pushbutton switch. Such pushbutton switches can be provided e.g. in the lower recessed grips 40, 42, 44 (cf. FIG. 2*a*). Other switching elements such as rocker switches, thumbwheel switches etc. can also be provided for selecting relevant control options.

In the case of a crane, it could be envisaged, for instance, that the lowering or raising of the crane hook is controlled by the pivoting movement about the rotation axis DA. A tilting movement about the tilt axis KA could be used, for example, for controlling the movement of the crane trolley along the jib. Obviously other control options are also possible for a crane depending on the crane design and depending on the design of the radio remote control system or of the associated hand-held unit.

Even if it is assumed in FIGS. 1 and 2 that rotational and tilting movements about two mutually orthogonal axes can be detected, it is quite conceivable that in a simpler version, the associated motion sensors can only detect movements about one of the axes DA or KA. In such a case, it would be possible, for instance, that tilting the hand-held unit 10 about the tilt axis KA causes rotation of the crane about its rotation axis, and that raising or lowering the crane hook and moving the crane trolley is performed by operating the joystick 14.

Figure 3:
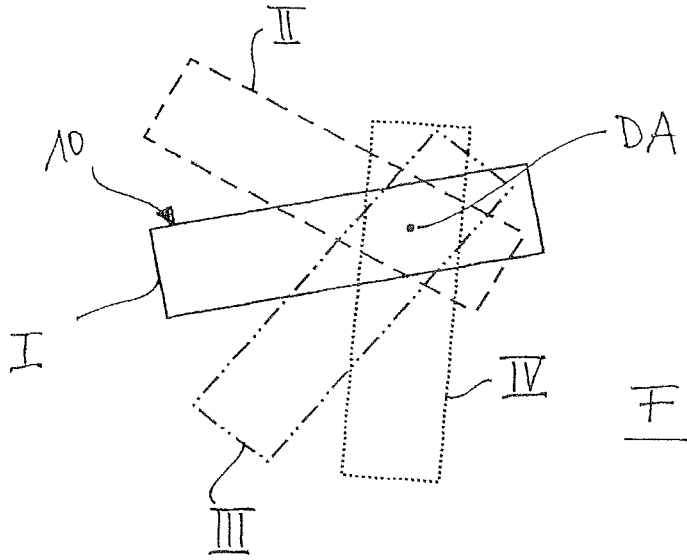
FIG. 3 shows a highly simplified diagram of the movement positions of a hand-held unit in the case of a first control mode.

FIG. 3 shows as a schematic rectangular representation, different movement positions of the hand-held unit 10 about its rotation axis DA. In a first control mode, a current attitude I of the hand-held unit 10 in space can be adopted as a reference attitude. As shown in FIG. 3, this reference attitude I is slightly inclined with respect to a horizontal in this example. A comfortable pose for such a hand-held unit usually lies in an angular range of +/−20° about the horizontal. In the example of FIG. 3, on activating what is called a motion control mode, for example by pressing a control button 16 or 18 (FIG. 1), the current attitude I of the hand-held unit 10 in space is detected and adopted as the reference attitude for the subsequent motion detection. Rotational or pivoting movements of the hand-held unit 10 about the rotation axis DA into movement positions II or III can then be evaluated in relation to the reference attitude I and converted into control commands that are transmitted to the machine to be controlled remotely. The movement position IV illustrates an attitude of the hand-held unit 10 in which a maximum angle of rotation in relation to the reference attitude I has been exceeded. If the hand-held unit 10 is brought from the reference attitude or a movement position II or III into such a movement position IV, generation of control commands on the basis of the detected movements can be suspended (termination of motion control mode). A movement position IV may be reached, for example, if a user who is holding the hand-held unit 10 in the hand with the arm bent, then stretches the arm downwards so that the hand-held unit is directed substantially vertically towards the ground.

Figure 4:
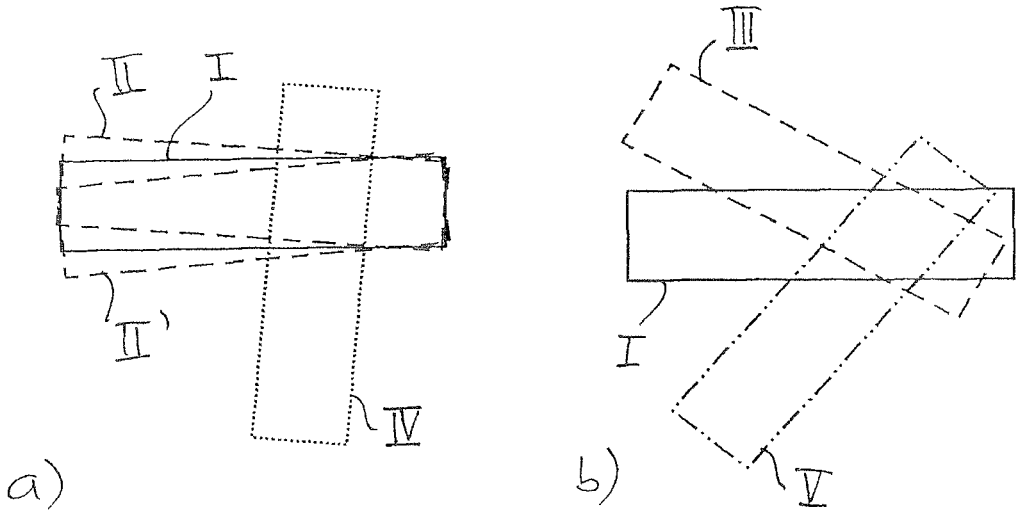
FIG. 4 shows in the sub-figures a) and b) different movement positions of a hand-held unit for a second control mode.

FIG. 4 shows in the sub-figures a) and b) a different control mode. Assuming that the motion control mode is activated starting from a movement position IV, the hand-held unit must initially be brought into a movement position II or II', which corresponds approximately to a preset reference attitude I of the hand-held unit 10. Thus as soon as the hand-held unit 10 reaches a position that corresponds to the movement position II', for example, the movements of the hand-held unit that are then detected are again converted into control commands, which can be communicated to the machine. This is indicated in FIG. 2 *b*) by the movement positions III and V.

The motion control mode can be disabled, so that the detected movements are no longer converted into control commands, by actuating a control button 16, 18 on the hand-held unit 10, or, as described above with reference to FIG. 3, by a defined angular range being left and the hand-held unit being brought into the movement position IV, for example.

Figure 5:
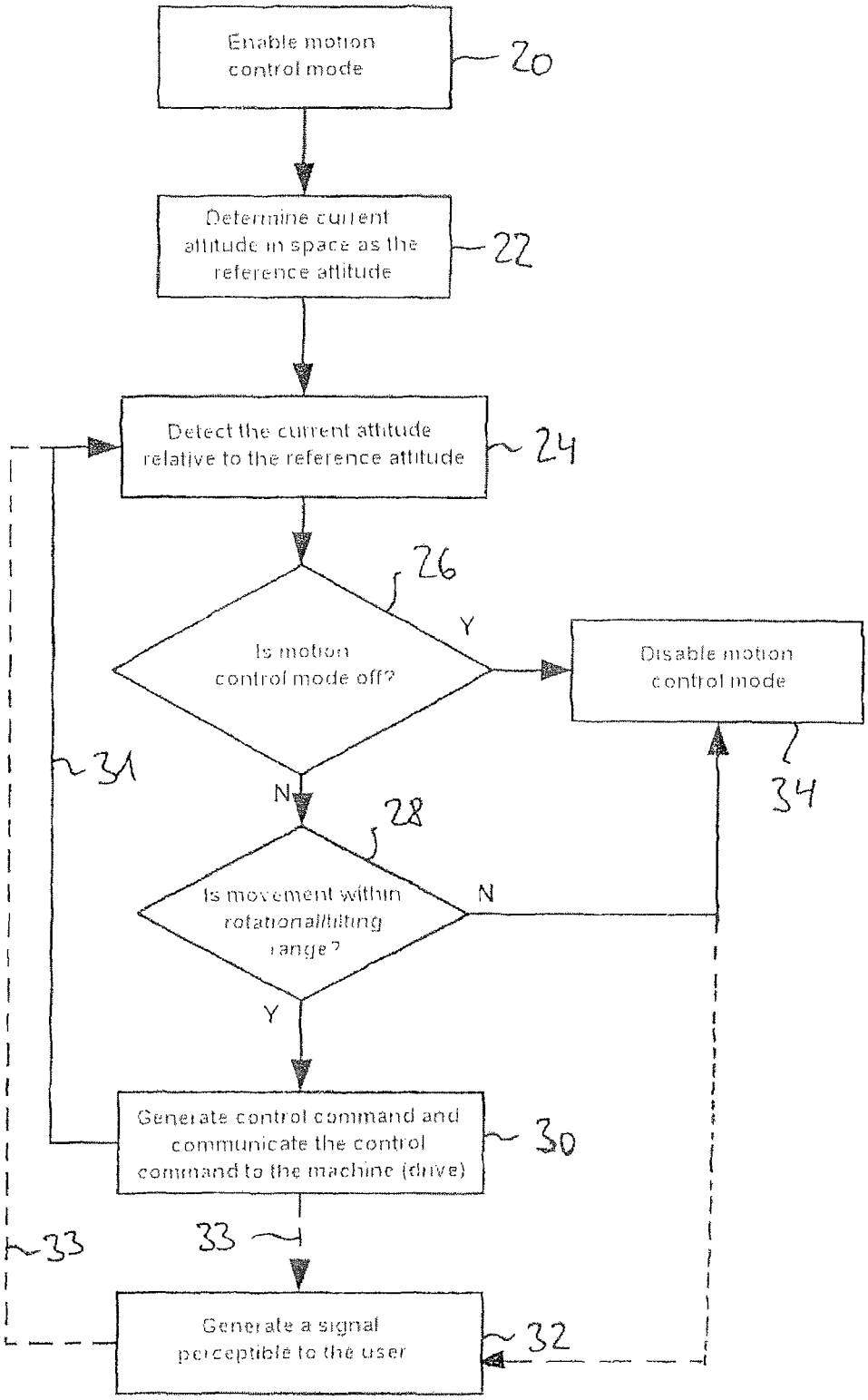
FIG. 5 is a flowchart of a possible control method.

FIG. 5 shows a simplified flowchart for a control mode according to FIG. 3, in which a current attitude in space is determined as the reference attitude. In a first step 20, a control unit, which is normally accommodated in the housing 12 of the hand-held unit 10, detects whether the motion control mode is enabled, for example by pressing the control buttons 16, 18. After enabling the motion control mode, which is used to convert detected movements into control commands and to communicate these control commands to the machine, the current attitude (cf. I in FIG. 3) of the hand-held unit in space is determined as the reference attitude (step 22). Then, in step 24, the current attitude is detected and related to the reference attitude I. Step 26 involves a question as to whether the motion control mode has been disabled. If this is not the case (N), a check is made in step 28 as to whether the hand-held unit is moved within a preset rotation/tilt range. If the rotation/tilt range has been left (N), the motion control mode is disabled in step 34, and, if applicable, a signal perceptible to the user is generated at the hand-held unit 10. If the movement lies within the rotation/tilt range (Y) in step 28, a control command calculated according to the detected movement is generated in step 30 and communicated to the machine to be controlled remotely or to a machine component to be driven. While the motion control mode is enabled, steps 24 to 30 are normally repeated successively in order to be able to detect continuously changing movement positions of the hand-held unit 10 and to be able to generate corresponding control commands. This loop is indicated by the arrow 31.

The hand-held unit preferably also comprises an output means (not shown in the drawings), which generates at the hand-held unit in response to detected movements at least one output perceptible to the user, in particular an optical and/or acoustic and/or haptic signal. This is done for example in step 32. This step 32 extends the repeated loop comprising steps 24 to 32, which is indicated by the dashed arrows 33 bypassing the arrow 31. By generating a signal perceptible to the user, it is possible during the rotational or tilting movement of the hand-held unit 10 producing an angular deflection and during the control command generated thereby to give a feedback to the user that is perceptible using the senses of hearing, touch or vision, which feedback gives a control confidence that can be experienced subjectively by the user, as the user is familiar with or previously accustomed to, for example, from remote control using a joystick or pushbuttons or the like. Generating a signal perceptible to the user can be specified e.g. on leaving the reference attitude and on reaching a first level, which, for example, corresponds to a velocity of the machine part to be controlled remotely. When this first level is reached and a further tilting or rotational movement of the hand-held unit is made, a second level of a speed controller (rapid speed), for instance, can be reached, which is perceptible to the user by a different signal, in particular a signal that can be experienced more intensely. If the speed leaves speed level II again and returns to level I, this can likewise be made perceptible to the user by a suitable signal. If the signal perceptible to the user is in the form of a haptic and/or acoustic signal, the user can concentrate visually on the remotely controlled components of the machine while remotely controlling the machine, and need not be forced to look at the hand-held unit 10. The movements that the user performs with the hand-held unit 10 are made perceptible to the user by acoustic and/or haptic signals in a form of feedback, so that the user can perform further movements or counter-movements with the hand-held unit 10 according to the perceived signals in order to be able to perform the desired remote control of the machine.

In addition to the output of signals perceptible to the user on reaching certain levels in the manner mentioned above by way of example, such signals can also be output in proportion to the detected movements. It is thereby conceivable, for instance, to make it possible to experience acoustically/haptically the increase or reduction in the detected angle of rotation or tilt, where it is quite possible that for the increase in the angle, a different signal is output than for the reduction in the angle. If the hand-held unit is held still in a certain angular position the relevant signal is not output, and it is not output again until the hand-held unit is moved. Alternatively, it is possible that an acoustic and/or haptic signal is output constantly during the entire motion control mode and preferably is also designed to be proportional to the detected angle of rotation or tilt. For instance it is thus possible that a user senses only a weak vibration when holding the hand-held unit in or close to the reference attitude. During a rotational or tilting movement of the hand-held unit, the vibration increases with increasing pivoting of the hand-held unit, so that the user can detect haptically the movement away from the reference attitude. Obviously this signalling can also be made acoustically.

The proportional output of a signal perceptible to the user is here not limited to a directly proportional dependency between detected movement and signal strength. Instead, a logarithmic signal distribution is also envisaged, which is better suited to human sensation. Both the acoustic and the haptic or vibrational feedback signal (signal perceptible to the user) can be composed, for example, of vibration pulses or short-burst chains of vibration pulses, the gap between which would decrease with increasing angle of rotation or tilt, and hence the sensed intensity thereof would increase.

An acoustic and/or haptic and/or optical output at the hand-held unit can also be output when the reference attitude is reached or when a switch-off situation is reached, for example on reaching angles of approximately +/−45° relative to the reference attitude.

According to an extended variant of the invention (not shown in the drawings), the hand-held unit 10 contains a feedback receiver, which is configured to receive feedback information from the machine to be controlled, where it is assumed in this case that a feedback transmitter transmitting such feedback information is provided on the machine. In the simplest case, the receiver on the machine can comprise a feedback transmitter which acknowledges the receipt of control commands, and therefore the feedback information involves confirmations of the receipt of control commands. If these expected radio receive confirmations are not registered by the hand-held unit 10, a relevant output means of the hand-held unit 10 can notify the user of a possible fault.

In a further development level of the radio remote control system according to the invention, said system comprises a sensor device that acquires data about the actual position of the moveable machine part at that moment and/or about the state of motion of said part, and a feedback transmitter on the machine transmitting the data from this sensor device as feedback information, wherein the feedback receiver of the hand-held unit can receive this feedback information and pass it to the control unit. According to a variant of the invention, the control unit can then modify control commands for the machine according to the received feedback information. The output means in the form of an indication device can also be designed such that it represents the actual position at that moment and/or the current deviation of the actual position from the setpoint position defined by the instantaneous attitude of the hand-held unit and/or the velocity of movement of the moveable machine part. An optical and/or acoustic and/or haptic indication or output is also possible in this context.

The invention claimed is:

1. Radio remote control system of a machine that comprises at least one machine drive for a moveable machine part, which machine drive can be controlled by the radio remote control system, comprising a radio receiver assigned to the machine, a hand-held unit (10) comprising a control unit, a transmitter and at least one motion sensor, wherein the control unit is configured to communicate control commands issued by a user to the transmitter, and to cause the transmitter to transmit the control commands to the receiver, and wherein movements of the hand-held unit (10) in space about at least one tilt axis or pitch axis (KA, DA) can be detected by the motion sensor in such a way that in a motion control mode, the detected movements can be converted by the control unit into control commands, which can be communicated to the machine by radio transmission between transmitter and receiver, wherein the motion control mode can be activated by a user input at the hand-held unit (10), characterised in that the receiver comprises a feedback transmitter and is configured, on receiving control commands, to activate the feedback transmitter to transmit feedback information, and wherein the hand-held unit comprises a feedback receiver that is configured to receive the feedback information and is connected to the control unit and comprises an acoustic and/or haptic indication device which is controlled by the control unit and which can be used to indicate operating function information from the radio remote control system according to the receipt of feedback signals from the feedback transmitter.

2. Radio remote control system of a machine according to claim 1, characterised in that the control unit is configured such that on activating the motion control mode, the current attitude (I) of the hand-held unit (10) in space is detected as the current reference attitude (I), so that movements can be detected by the motion sensor relative to this current reference attitude (I), and can be communicated by the control unit as control commands to the machine.

3. Radio remote control system of a machine according to claim 1, characterised in that the radio remote control system is configured such that on activating the motion control mode, the current attitude (IV) of the hand-held unit (10) in space is detected, and is compared with a predetermined reference attitude (I), and that detected movements cannot be communicated to the machine as control commands until the radio remote control system has been brought at least approximately (II, II') into the predetermined reference attitude (I), wherein movements relative to the predetermined reference attitude are detected for the purpose of generating control commands.

4. Radio remote control system according to claim 1, characterised in that a sensor device that acquires data about the actual position of the moveable machine part at that moment and/or about the state of motion of said part, and a transmitter transmitting the data from this sensor device as feedback information, are provided on the machine, and that the hand-held unit comprises a feedback receiver that is configured to receive the feedback information and is connected to the control device.

5. Radio remote control system according to claim 4, characterised in that the hand-held unit has an optical and/or acoustic and/or haptic indication device which is controlled by the control unit and represents the actual position at that moment and/or the current deviation of the actual position from the setpoint position defined by the instantaneous attitude of the hand-held unit and/or the velocity of movement of the moveable machine part.

6. Radio remote control system according to claim 1, characterised in that the control unit is configured to modify control commands for the machine according to the received feedback information.

7. Radio remote control system according to claim 1, characterised in that it comprises at least one output means assigned to the hand-held unit (10), said output means being configured such that it generates at the hand-held unit in response to detected movements of the hand-held unit at least one output perceptible to the user, in particular an optical and/or acoustic and/or haptic signal.

8. Radio remote control system according to claim 7, characterised in that the output means are configured such that the output perceptible to the user is generated on the basis of the signals output by the motion sensor.

9. Radio remote control system according to claim 8, characterised in that the output means are configured such that the output perceptible to the user is generated in a graduated manner on the basis of reaching certain signal strengths output by the motion sensor.

10. Radio remote control system according to claim 9, characterised in that the output means is configured such that the output perceptible to the user is generated such that it is proportional to the signal strength output by the motion sensor.

11. Radio remote control system according to claim 1, characterised in that the control unit is configured such that movements detected by the or a motion sensor in a rotational or tilting working range of approximately −45° to +45° maximum, in particular −30° to +30°, about an associated horizontal rotation axis or tilt axis, are converted into control commands for the machine.

12. Radio remote control system according to claim 11, characterised in that the output means are configured such that they indicate by a suitable output perceptible to the user that the maximum rotational or tilting movement is being approached and/or the rotational or tilting working range is being left.

13. Radio remote control system according to claim 11, characterised in that the control unit is configured such that on leaving the rotational or tilting working range, no further control commands are generated as a result of detected movements.

* * * * *